US007120587B2

(12) United States Patent
Heusdens et al.

(10) Patent No.: US 7,120,587 B2
(45) Date of Patent: Oct. 10, 2006

(54) SINUSOIDAL MODEL BASED CODING OF AUDIO SIGNALS

(75) Inventors: Richard Heusdens, Alkmaar (NL); Renat Vafin, Stockholm (SE); Willem Bastiaan Kleijn, Stocksund (SE)

(73) Assignee: Koninklijke Philips Electronics N.V., Eindhoven (NL)

( * ) Notice: Subject to any disclaimer, the term of this patent is extended or adjusted under 35 U.S.C. 154(b) by 789 days.

(21) Appl. No.: 10/169,345

(22) PCT Filed: Oct. 31, 2001

(86) PCT No.: PCT/EP01/12721

§ 371 (c)(1),
(2), (4) Date: Jul. 1, 2002

(87) PCT Pub. No.: WO02/37476

PCT Pub. Date: May 10, 2002

(65) Prior Publication Data

US 2003/0009332 A1 Jan. 9, 2003

(30) Foreign Application Priority Data

Nov. 3, 2000 (EP) ..... 00203856
May 8, 2001 (EP) ..... 01201685

(51) Int. Cl.
*G10L 19/02* (2006.01)

(52) U.S. Cl. ..... 704/500; 704/205

(58) Field of Classification Search ..... 704/200.1, 704/203, 205, 503
See application file for complete search history.

(56) References Cited

U.S. PATENT DOCUMENTS 5,394,473 A * 2/1995 Davidson ..... 704/200.1
5,475,789 A * 12/1995 Nishiguchi ..... 704/200
5,651,090 A * 7/1997 Moriya et al. ..... 704/200.1
6,202,045 B1 * 3/2001 Ojala et al. ..... 704/203
6,611,800 B1 * 8/2003 Nishiguchi et al. ..... 704/221

OTHER PUBLICATIONS

"Sinusoidal Modeling Using Psychoacoustic-Adaptive Matching Pursuits", Richard Heusdens, et al.

"IEEE Transactions on Signal Processing" A Publication of the IEEE Signal Processing Society, Jul. 1999, vol. 47, No. 7 ITPRED (ISSN 1053-587X).

"Speech Processing II Audio and Electroacoustics Neural Networks for Signal Processing", 1999 IEEE International Conference on Acoustics, Speech, and Signal Processing, vol. II of VI, Mar. 15-19, 1999.

"Signal Processing Theory and Methods II Audio and Electroacoustics Speech Processing I", 2000 IEEE International Conference on Acoustics, Speech, and Signal Processing, vol. II of VI, Jun. 5-9, 2000.

(Continued)

*Primary Examiner*—Leonard Saint-Cyr

(57) ABSTRACT

An apparatus and method of signal coding includes an analysis-by-synthesis algorithm for sinusoidal modeling. An input signal to be modeled is divided in time to produce a plurality of frames. Functions from a dictionary are selected to form an approximation of the section of the input signal contained in each frame, with the selection carried out based on a psychoacoustic norm. The function dictionary is made up of complex exponentials and these are selected iteratively to make up the section of the input signal contained in each frame. The psychoacoustic norm adapts after each iteration according to the changing masking threshold of the residual signal to be modeled in the next step.

17 Claims, 1 Drawing Sheet

OTHER PUBLICATIONS

Figure 1:
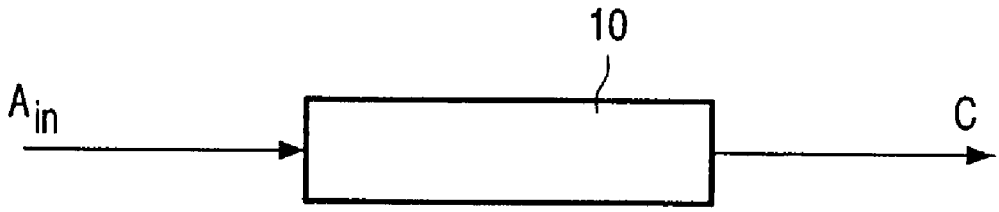

R. Heusdens et al; "Sinusoidal Modeling of Audio and Speech Using Psychoaccoustic-Adaptive Matching Pursuits", 2001 IEEE International Conference on Acoustics, Speech, and Signal Processing. Proceedcings (CAT. No. 01CH37221), 2001 IEEE International Conference on Acoustics, Speech, and Signal Processing. Proceedings, Salt Lake City, UT, May 7-11, 2001, pp. 3281-3284, vol. 5, XP002188873.

Ahmadi, S. et al, "A new phase model for sinusoidal transform coding of speech", IEEE Transactions on Speech and Audio Processing, vol. 6, No. 5, Sep. 1998.

* cited by examiner

SINUSOIDAL MODEL BASED CODING OF AUDIO SIGNALS

The present invention relates to an apparatus for and a method of signal coding, in particular, but not exclusively to a method and apparatus for coding audio signals.

Sinusoidal modelling is a well-known method of signal coding. An input signal to be coded is divided into a number of frames, with the sinusoidal modelling technique being applied to each frame. Sinusoidal modelling of each frame involves finding a set of sinusoidal signals parameterised by amplitude, frequency, phase and damping coefficients to represent the portion of the input signal contained in that frame.

Sinusoidal modelling may involve picking spectral peaks in the input signal. Alternatively, analysis-by-synthesis techniques may be used. Typically, analysis-by-synthesis techniques comprise iteratively identifying and removing the sinusoidal signal of the greatest energy contained in the input frame. Algorithms for performing analysis-by-synthesis can produce an accurate representation of the input signal if sufficient sinusoidal components are identified.

A limitation of analysis-by-synthesis as described above is that the sinusoidal component having the greatest energy may not be the most perceptually significant. In situations where the aim of performing sinusoidal modelling is to reduce the amount of information needed to represent an input signal, modelling the input signal according to the energy of spectral components may be less efficient than modelling the input signal according to the perceptual significance of the spectral components. One known technique that takes the psychoacoustics of the human hearing system into account is weighted matching pursuits. In general, matching pursuit algorithms approximate an input signal by a finite expansion of elements chosen from a redundant dictionary. Using the weighted matching pursuits method, the dictionary elements are scaled according to a perceptual weighting.

To better explain the weighted matching pursuit method, a general matching pursuit algorithm will be described. The general matching pursuits algorithm chooses functions from a complete dictionary of unit norm elements in a Hilbert space H. If the dictionary contains elements $g_\gamma$ and is given by $D=(g_\gamma)_{\gamma\in\Gamma}$ then H is the closed linear span of the dictionary elements. An input signal of $x\epsilon H$ is projected onto the dictionary elements $g_\gamma$ and the element that best matches the input signal x is subtracted from the input signal x to form a residual signal. This process repeats with the residual from the previous step taken as the new input signal. Denoting the residual after m−1 iterations as $R^{m-1}x$ and the dictionary element that best matches $R^{m-1}x$ as $g_{\gamma m}$, the residual at the iteration m is decomposed according to $$R^{m-1}x=<R^{m-1}x,g_{\gamma m}>g_{\gamma m}+R^m x \tag{1}$$

where $g_{\gamma m}\epsilon D$ is such that $$|\langle R^{m-1}x,\ g_{\gamma m}\rangle| = \sup_{\gamma\in\Gamma}|\langle R^{m-1}x,\ g_\gamma\rangle| \tag{2}$$

The orthogonality of $R^m x$ and $g_{\gamma m}$ implies $$\|R^{m-1}x\|^2=|<R^{m-1}x,g_{\gamma m}>|^2+\|R^m x\|^2$$

This algorithm becomes the weighted matching pursuit when the dictionary elements $g_\gamma$ are scaled to account for human auditory perception.

Due to the bias introduced by the weighting of the dictionary elements, the weighted matching pursuit algorithm may not choose the correct dictionary element when the signal to be modelled consists of one of the dictionary elements. In addition, the weighted matching pursuit algorithm may have difficulty discriminating between side lobe peaks introduced by windowing an input signal to divide it into a number of frames and the actual components of the signal to be modelled.

It is an aim of the preferred embodiments of the present invention to provide a method of e.g. sinusoidal modelling based on analysis-by-synthesis that offers improvements in the selection of dictionary elements when approximating sections of a signal contained in a frame of limited length. To this end, the invention provides a method of signal coding, a coding apparatus and a transmitting apparatus as defined in the independent claims. Advantageous embodiments are defined in the dependent claims.

A first aspect of the invention provides (a) defined by receiving an input signal;

(b) dividing the input signal in time to produce a plurality of frames each containing a section of the input signal; and (c) selecting functions from a function dictionary to form an approximation of the signal in each frame;

wherein the selection process of step (c) is carried out on the basis of a norm which is based on a combination, such as a product, of a weighting function expressed as a function of frequency and a product of a window function defining each frame in the plurality of frames and the section of the input signal to be modelled, the product of the window function and the section of the input signal to be modelled being expressed as a function of frequency. This norm may be defined by $$\|Rx\|=\sqrt{\int \bar{a}(f)|(\overline{wRx})(f)|^2 df} \tag{3},$$

in which Rx represents a section of the input signal to be modelled, $\bar{a}(f)$ represents the Fourier transform of a weighting function expressed as a function of frequency and $(\overline{wRx})(f)$ represents the Fourier transform of the product of a window function defining each frame in the plurality of frames, w, and Rx, expressed as a function of frequency.

Preferably, the norm incorporates knowledge of the psychoacoustics of human hearing to aid the selection process of step (c).

Preferably, the knowledge of the psychoacoustics of human hearing is incorporated into the norm through the function $\bar{a}(f)$. Preferably, $\bar{a}(f)$ is based on the masking threshold of the human auditory system. Preferably, $\bar{a}(f)$ is the inverse of the masking threshold.

Preferably, the selection process of step (c) is carried out in a plurality of substeps, in each substep a single function from a function dictionary being identified.

Preferably, the function identified at the first substep is subtracted from the input signal in the frame to form a residual signal and at each subsequent substep a function is identified and subtracted from the residual signal to form a further residual signal.

Preferably, the sum of the functions identified at each substep forms an approximation of the signal in each frame.

Preferably, the norm adapts at each substep of the selection process of step (c).

Preferably, a new norm is induced at each substep of the selection process of step (c) based on a current residual signal. Preferably, as the residual signal changes at each substep, $\bar{a}(f)$ is updated to take into account the masking characteristics of the residual signal. Preferably, $\bar{a}(f)$ is updated by calculation according to known models of the masking threshold, for example the models defined in the MPEG layer 3 standard. In alternative embodiments, the function $\bar{a}(f)$ may be held constant to remove the computational load imposed by re-evaluating the masking characteristics of the residual at each iteration. Suitably, the function $\bar{a}(f)$ may be held constant based on the masking threshold of the input signal to ensure convergence. The masking threshold of the input signal is preferably also calculated according to a known model such as the models defined in the MPEG layer 3 standard.

Preferably, the function $\bar{a}(f)$ is based on the masking threshold of the human auditory system and is the inverse of the masking threshold for the section of an input signal in a frame being coded and is calculated using a known model of the masking threshold.

Preferably, the norm is induced according to the inner product $$\langle x, y\rangle = \int_0^1 \bar{a}(f)(\overline{wx})(f)(\overline{wy})^*(f)df \tag{4}$$

Preferably, denoting the residual at iteration m as $R^m x$ and the weighting function from the previous iteration $\bar{a}_{m-1}$ the function identified from the function dictionary minimises $\|R_m x\|_{\bar{a}_{m-1}}$, where $\|*\|_{\bar{a}_{m-1}}$ represents the norm calculated using $\bar{a}_{m-1}$.

Preferably, the convergence of the method of audio coding is guaranteed by the validity of the theorem that for all m>0 there exists a $\lambda>0$ such that $\|R^m x\|_{\bar{a}_m} \leqq 2^{-\lambda m}\|x\|_{\bar{a}_0}$ where x represents an initial section of the input signal to be modelled.

Preferably, the convergence of the method of audio coding is guaranteed by the increase or invariance in each frame of the masking threshold at each substep, such that $\bar{a}_m(f) \leqq \bar{a}_{m-1}(f)$ over the entire frequency range $f\epsilon[0,1)$.

The window function may be a Hanning window. The window function may be a Hamming window. The window function may be a rectangular window. The window function may be any suitable window.

The invention includes a coding apparatus working in accordance with the method.

Figure 2:
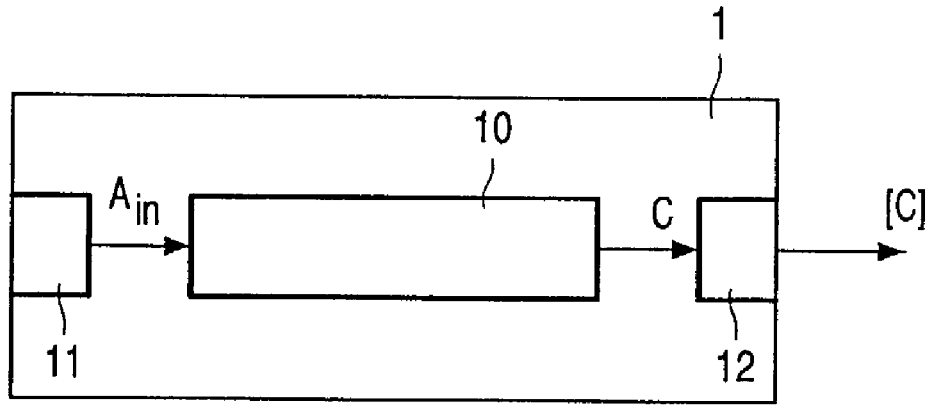

For a better understanding of the present invention, and to describe how it may be put into effect, preferred embodiments of the invention will now be described, by way of example only and with the aid of the following drawings, of which FIG. 1 shows an embodiment of a coding apparatus working in accordance with the teachings of the present invention, and FIG. 2 shows a transmitting apparatus according to an embodiment of the invention.

In each of the following embodiments, there is described a particular step in an audio coding process, namely the step of selecting functions from a function dictionary to form an approximation of the signal in each frame. This selection step is the critical third step (c) in the audio coding methods described which also include the initial steps of: (a) receiving an input signal; and (b) dividing the input signal in time to produce a plurality of frames each containing a section of the input signal.

The steps (a) and (b) referred to above are common to many signal coding methods and will be well understood by the man skilled in the art without further information.

In each of the embodiments of the invention described below, the selection step (c) comprises selecting functions from a function dictionary to form an approximation of the signal in each frame, the selection process being carried out on the basis of a norm defined by $$\|Rx\| = \sqrt{\int_0^1 \bar{a}(f)|(\overline{wRx})(f)|^2 df} \tag{3},$$

in which Rx represents a section of the input signal to be modelled, $\bar{a}(f)$ represents the Fourier transform of a weighting function expressed as a function of frequency and $(\overline{wRx})(f)$ represents the Fourier transform of the product of a window function defining each frame in the plurality of frames, w, and Rx, expressed as a function of frequency.

A first embodiment of the invention will now be described. In this embodiment the dictionary elements comprise complex exponentials such that $D=(g_\gamma)_{\gamma\epsilon\Gamma}$ $$\text{where } g_\gamma = \frac{1}{\sqrt{N}} e^{i2\pi\gamma n} \quad n = 0, \ldots, N-1$$

for $\gamma\epsilon[0,1)$.

To find the best matching dictionary element at iteration m, the inner product of $R^{m-1}x$ and each of the dictionary elements is evaluated. In this embodiment, the evaluation of the inner products $<R^{m-1}x,g_\gamma>$ is given by $$\langle R^{m-1}x, g_\gamma\rangle = \frac{1}{\sqrt{N}} \int_0^1 \bar{a}_{m-1}(f)(\overline{wR^{m-1}x})(f)\bar{w}^*(f-\gamma)df \tag{5}$$

The function $\bar{a}(f)$ incorporates knowledge of the psychoacoustics of human hearing in that it comprises the inverse of the masking threshold of the human auditory system, as modelled using a known model based on the residual signal from the previous iteration. At the first iteration, the masking threshold is modelled based on the input signal.

The best matching dictionary element is then evaluated according to the well known and previously disclosed Equation (2) and the residual evaluated according to Equation (1)

The use of a structured dictionary such as that described for this embodiment of the invention can considerably reduce the computational complexity of evaluating the inner products $<R^{m-1}x,g_\gamma>$. In the case of the dictionary of complex exponentials as described in this embodiment of the invention, Equation (5) can be calculated using the Fourier transform:

$$\begin{aligned}\langle R^{m-1}x, g_\gamma\rangle &= \frac{1}{\sqrt{N}} \int_0^1 \bar{a}_{m-1}(f)(\overline{wRx})(f)\bar{w}^*(f-\gamma)df \\ &= \frac{1}{\sqrt{N}} \sum_{n\epsilon Z}\left(\int_0^1 \bar{a}_{m-1}(f)(\overline{wR^{m-1}x})(f)e^{i2\pi fn}df\right) \\ &\quad w^*(n)e^{-i2\pi\gamma n}\end{aligned} \tag{6}$$

Hence, to compute $<R^{m-1}x,g_\gamma>$ for all $\gamma$ the Fourier transform of $wR^{m-1}x$ is calculated and the result multiplied by $\bar{a}$. The inverse Fourier transform of the product is then calculated, the result multiplied by w* and then Fourier transformed. In this way the result of Equation (6) can be computed using three Fourier transform operations.

Once the best matching dictionary element at this iteration has been chosen, it is subtracted from the residual signal, with the result of the subtraction forming the signal to be modelled at the next iteration. In this way an approximation comprising the sum of the dictionary elements identified at each iteration can be built up.

By taking the sum of each complex exponential function with its complex conjugate a real valued sinusoid can be produced. In this way the real input signal can be estimated. This technique requires a pair of dictionary elements $(g_\gamma^*, g_\gamma)$ to be found at each iteration. In order to reconstruct the real sinusoidal signal, the inner product $<g_\gamma^*, g_\gamma>$ must also be found. These inner products do not have an efficient implementation in terms of Fourier transforms, but because the value of $<g_\gamma^*, g_\gamma> \approx 0$ for $\gamma$ away from 0 or ½ it is possible to avoid calculating the inner products for most of the range of $\gamma$ values. For this reason the complexity of estimating the best matching set $<g_\gamma^*, g_\gamma>$ is of the same order of magnitude as for finding the best matching exponential function $g_\gamma$.

A second embodiment is based upon the first embodiment described above, but differs from it in that N is very large. In this case, $\overline{w}(f)$ tends to a Dirac delta function and the equation $$\langle R^{m-1}x, g_\gamma \rangle = \frac{1}{N}\int_0^1 \overline{a}_{m-1}(f)(\overline{wR^{m-1}x})(f)\overline{w}^*(f-\gamma)df \tag{5}$$

reduces to $$\langle R^{m-1}x, g_{\gamma m} \rangle = \frac{1}{\sqrt{N}}\overline{a}_{m-1}(\gamma)(\overline{R^{m-1}x})(\gamma) \tag{7}$$

Hence, the matching pursuits algorithm chooses $g_\gamma \epsilon D$ such that $$|\langle R^{m-1}x, g_{\gamma m} \rangle| = \frac{1}{\sqrt{N}}\sup_{\gamma\in\Gamma}\left|\overline{a}_{m-1}(\gamma)(\overline{R^{m-1}x})(\gamma)\right| \tag{8}$$

In this embodiment, the result obtained at each iteration gives the maximum absolute difference between the logarithmic spectrum of the residual signal and the logarithmic masking threshold.

If $\overline{a}_{m-1}$ is the reciprocal of the masking threshold at iteration m this procedure selects the complex exponential located where the absolute difference between the residual signal spectrum and the masking threshold is largest. Evaluating the inner products required to identify the desired dictionary element at each iteration according to Equation (2) can become computationally intensive for the first and second embodiments when a large number of dictionary elements exist.

A third embodiment of the invention shares steps of the methods of the first and second invention in relation to receiving and dividing an input signal. Similarly, a function identified from the function dictionary is used to produce a residual to be modelled at the next iteration, however in a third embodiment, the function $\overline{a}(f)$ does not adapt according to the masking characteristics of the residual at each iteration but is held independent of the iteration number. It is known for any general inner product that Equation (1) can be reduced to $$<R^m x, g_\gamma> = <R^{m-1}x, g_\gamma> - <R^{m-1}x, g_{\gamma m}><g_{\gamma m}, g_\gamma> \tag{9}$$

Thus, if $\overline{a}(f)$ is held constant independent of iteration number, using the definition of the norm of the present invention as induced by the inner product of Equation (4) the only extra computations required at each iteration are to evaluate the inner products $<g_{\gamma m}, g_\gamma>$. The value of these inner products, namely the inner products of each dictionary element with all dictionary elements, can be computed beforehand and stored in memory. If the function $\overline{a}(f)$ is held equal to unity over all frequencies, the method reduces to the known matching pursuit algorithm. However, $\overline{a}(f)$ may take any general form. A particularly advantageous arrangement is to hold $\overline{a}(f)$ equal to the inverse of the masking threshold of the complete input signal. This arrangement converges according to the inequality above and has advantages in terms of ease of computation.

Referring now to FIG. 1, there is shown in schematic form an embodiment of a coding apparatus working in accordance with the teachings of the present invention.

In FIG. 1, there is shown a signal coder 10 receiving an audio signal $A_{in}$ at its input and processing it in accordance with any of the methods described herein, prior to outputting code C. The coder 10 estimates sinusoid parameters by use of a matching pursuit algorithm, wherein psycho-acoustic properties of e.g. a human auditory system are taken into account by defining a psycho-acoustic adaptive norm on a signal space.

The embodiments described above provide methods for signal coding particularly suitable for use in relation to speech or other audio signals. The methods according to embodiments of the present invention incorporate knowledge of the psychoacoustics of the human auditory system (such that the function $\overline{a}(f)$ is the inverse of the masking threshold of the human auditory system) and provide advantages over other known methods when the signal to be coded is of limited duration without a significant increase in computational complexity.

FIG. 2 shows a transmitting apparatus 1 according to an embodiment of the invention, which transmitting apparatus comprises a coding apparatus 10 as shown in FIG. 1. The transmitting apparatus 1 further comprises a source 11 for obtaining the input signal $A_{in}$. which is e.g. an audio signal. The source 11 may e.g. be a microphone, or a receiving unit/antenna. The input signal $A_{in}$ is furnished to the coding apparatus 10, which codes the input signal to obtain the coded signal C. The code C is furnished to an output unit 12 which adapts the code C in as far as necessary for transmitting. The output unit 12 may be a multiplexer, modulator, etc. An output signal [C] based on the code C is transmitted. The output signal [C] may be transmitted to a remote receiver, but also to a local receiver or on a storage medium.

Although the embodiments of the invention have been described in relation to audio coding, it will be apparent to the skilled person that the method of the invention can be utilized in full or in part in other signal coding applications.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of signal coding, the method comprising the acts of:

(a) receiving an input signal;

(b) dividing the input signal in time to produce a plurality of frames each containing a section of the input signal; and (c) selecting functions from a function dictionary to form an approximation of the signal in each frame, the selecting act being carried out in sub-acts;

wherein the selection process of act (c) is carried out on the basis of a norm which is based on a combination, such as a product, of a weighting function expressed as a function of frequency and a product of a window function defining each frame in the plurality of frames and the section of the input signal to be modeled, the product of the window function and the section of the input signal to be modeled being expressed as a function of frequency; and wherein a new norm is induced at each of said sub-acts based on a current residual signal, the weighting function being updated to take into account masking characteristics of the residual signal.

2. The method of signal coding according to claim 1, wherein the norm is defined by $$\|Rx\|=\sqrt{\int \bar{a}(f)|(\overline{wRx})(f)|^2 df}$$

in which Rx represents a section of the input signal to be modeled, $\bar{a}(f)$ represents the weighting function expressed as a function of frequency and $(\overline{wRx})(f)$ represents the transform, such as a Fourier transform, of the product of the window function defining each frame in the plurality of frames, w, and Rx.

3. The method of signal coding according to claim 1, wherein the weighting function incorporates knowledge of the psychoacoustics of human hearing to aid the selecting act.

4. The method of signal coding according to claim 3, wherein the knowledge of the psychoacoustics of human hearing is incorporated into the norm through the function $\bar{a}(f)$.

5. The method of signal coding according to claim 4, wherein $\bar{a}(f)$ is based on the masking threshold of the human auditory system and is the inverse of the masking threshold.

6. The method of signal coding according to claim 5, wherein $\bar{a}(f)$ is computed using a known model of the masking threshold.

7. The method of signal coding according to claim 1, wherein in each of said sub-acts a single function from a function dictionary being identified.

8. The method of signal coding according to claim 7, wherein the function identified at a first sub-act of said sub-acts is subtracted from the input signal in the frame to form a residual signal and at each subsequent sub-act of said sub-acts a function is identified and subtracted from the residual signal to form a further residual signal, with the sum of the functions identified at each of said sub-acts forming an approximation of the signal in each frame.

9. The method of signal coding according to claim 1, wherein the norm adapts at each of said sub-acts.

10. The method of signal coding according to claim 1, wherein the function $\bar{a}(f)$ is based on the masking threshold of the human auditory system, is the inverse of the masking threshold for the section of an input signal in a frame being coded and is calculated using a known model of the masking threshold.

11. The method of claim 1, wherein the norm is induced according to the inner product:

$$\langle x, y\rangle = \int_0^1 \bar{a}(f)(\overline{wx})(f)(\overline{wy})^*(f)df.$$

12. The method of audio coding according to claim 11, wherein denoting a residual at iteration m as $R^m x$ and the weighting function from a previous iteration $\bar{a}_{m-1}$ a function identified from the function dictionary minimizes $\|R^m x\|_{\bar{a}_{m-1}}$, with $\|*\|_{\bar{a}_{m-1}}$ representing the norm calculated using $\bar{a}_{m-1}$.

13. The method of signal coding according claim 1, wherein convergence of the method of signal coding is guaranteed by validity of a theorem that for all m>0 there exists a $\lambda>0$ such that $\|R^m x\|_{\bar{a}_m} \leqq 2^{-\lambda m}\|x\|_{\bar{a}_0}$, where x represents an initial section of the input signal to be modeled.

14. The method of signal coding according to claim 11, wherein the selecting act is carried out in sub-acts, and wherein the convergence of the method of audio coding is guaranteed by the increase or invariance in each frame of the masking threshold at each of said sub-acts, such that $\bar{a}_m(f) \leqq \bar{a}_{m-1}(f)$ over the entire frequency range $f \epsilon [0,1)$.

15. The method of signal coding according to claim 1, wherein the window function is any one of a Hanning window, a Hamming window, a rectangular window or another suitable window.

16. A coding apparatus operating an accordance with the method of claim 1.

17. A transmitting apparatus comprising;

a source for providing an input signal;

a coding apparatus according to claim 16 for coding the input signal to obtain a coded signal, and an output unit for outputting the coded signal.

* * * * *